United States Patent [19]

Jiruše et al.

[11] Patent Number: 5,040,458

[45] Date of Patent: Aug. 20, 1991

[54] DEVICE FOR CONTROLLING IMPRESSIONAL FORCES

[75] Inventors: Jaroslav Jiruše, Rájec-Jestřebí; Václav Sedlák, Jedovnice; Valdimír Drlík, Bílovice; Alois Šebela, Senetářov; František Cípek, Adamov, all of Czechoslovakia

[73] Assignee: Admovské Strojírny, Adamov, Czechoslovakia

[21] Appl. No.: 626,306

[22] Filed: Dec. 12, 1990

[30] Foreign Application Priority Data

Dec. 22, 1989 [CS] Czechoslovakia ..... 7307-89

[51] Int. Cl.[5] ..... B41F 13/38; B41L 35/16

[52] U.S. Cl. ..... 101/216; 101/247

[58] Field of Search ..... 101/216, 217, 218, 247, 101/137, 139, 140, 143, 144, 145, 177, 182, 184, 185

[56] References Cited

U.S. PATENT DOCUMENTS

| | | | |
|---|---|---|---|
| 2,860,577 | 11/1958 | Fowlie | 101/218 |
| 3,030,884 | 4/1962 | Lindemann | 101/218 |
| 3,150,588 | 9/1964 | Bonsch | 101/218 |
| 3,584,578 | 6/1971 | Jurny | 101/218 |
| 4,041,862 | 8/1977 | Jiruse | 101/144 X |
| 4,538,513 | 9/1985 | Sedlák et al. | 101/218 |

*Primary Examiner*—J. Reed Fisher

*Attorney, Agent, or Firm*—Notaro & Michalos

[57] ABSTRACT

A device which performs the lifting and throw-off of an impression cylinder in a printing machine, comprises a first supporting pin (1) which carries a gate (2) that is provided with a run-out path (4) and stop (3). Upon disengagement of the impressional forces, the stop is in engagement with a first projection (6) on a first catch (7), which is swingably mounted on a second supporting pin (15), fixed in a side plate (16) of the machine. A connecting tie rod (9) is fastened to the first catch (7) by a pin (8), and another end of the connecting tie rod (9) is connected, by a second pin (10) to a second catch (11), mounted slightly turnably on a basic pin (28). The second catch is provided with a second projection (12), which becomes engaged with stop (3) of gate (2), upon engagement of impressional forces, and against the run-out path (4) which bears against an operating roller (13) of a driver (14).

9 Claims, 2 Drawing Sheets

DEVICE FOR CONTROLLING IMPRESSIONAL FORCES

FIELD AND BACKGROUND OF THE INVENTION

The present invention relates to a device for controlling impressional force, particularly in offset printing machines. The devices are intended for lifting in impression cylinders and their throw-off. Furthermore, the device can be used for controlling further steps of the printing machine, e.g. for controlling the inking rollers of the inking mechanism and for damping, i.e. their lifting in and their throw-off.

One of the devices hitherto known is controlled manually by means of a control lever. The mechanism of that device consists of a multi-arm lever, which is adjusted by means of a cam, a system of tie rods and a coupling link, provided with two projections. This device operates in such manner, that the offset roller is approached and withdrawn from the form roller and the impression cylinder, thus lifting in the said cylinders into imprinting force. The throw-off is derived from the disengaging roller on the pressure cylinder via a disengaging link, mechanically.

The disadvantage of this device consists in that it does not make possible a connection with electrical control elements. A further disadvantage consists in that an incorrect pulse cannot be corrected and that, upon starting a duty cycle, a self-retaining interval is necessary upon slight turning of the engaging link, for insuring that the engaging link does not return into its initial position, thus preventing the start of the duty cycle.

Another known device controls the impression cylinders by electromagnets. The mechanism of this device is arranged in such manner, that a two arm level is used for each step that is required. All two arm levers are adjusted by means of a cam. The duty cycle is controlled by a control link, which is provided with a control pin and a control recess.

The disadvantage of this device consists in that an incorrect pulse cannot be corrected, and for starting a duty cycle, a self-retaining interval is necessary upon slight turning of the control link. This self-retaining interval insures that the control link does not return into its initial position, whereby the possibility of preventing the start of the duty cycle is removed.

SUMMARY OF THE INVENTION

The said disadvantages are removed by the device according to the present invention, wherein a gate is mounted to be slightly turnable on a first supporting pin, which is fixed in a side plate of the device. The gate is provided with a run-out plate and a stop motion structure which, upon disengagement of impressional force, comes into engagement with the first projection formed on a first catch, mounted swingably on a second supporting pin fixed in the side plate. A connecting tie rod is fastened to the first catch by means of the first pin, said connecting tie rod being connected with its other end by means of a second pin to the second catch, mounted slightly turnably on the basic pin and provided with a second projection, which comes into engagement with the stop of the gate, upon engagement of printing pressure, on a run-out path which bears the controlling roller of the device driver. The first catch is connected, by means of the third pin, to the controlling tie rod which is, by means of draw pin of an adjustable link, fastened adjustably to the clutch, which is mounted displaceably in a guide and connected, by means of a fourth pin, to the core of an electromagnet, and against the guide, fastened to the side plate, bears one end of a pressure spring, of which the other end bears against the supporting ring mounted stationarily on the clutch.

The first pin of the connecting tie rod is located, in view of the second supporting pin, at the opposite side of the first catch from the first projection, and the second pin of the connecting tie rod is located, relatively to the basic pin, on the adjacent side of the second catch with the second projection, both the first and the second catch being, upon disengagement and engagement of the impressional force by the first and the second projection, simultaneously removed in the direction from the supporting pin.

The advantage of the said device consists in that, upon controlling the impressional forces by means of electromagnets, no self-retaining interval is necessary, since upon the displacement of both the first and the second catch, the gate changes, by action of the tension spring, its position in such manner, that it cannot be deflected back, when the catches bear again thereon. A further advantage of the device consists in that upon the start of the duty cycle, when the device sets the machine to impressional force, the electronic controller detects an incorrect pulse, whereupon the said device secures, that after emission of the pulse for disengagement of the impression rollers from impressional force, the disengagement of the driver and the driving gear is not performed. Thus, upon finishing the cycle of engagement into impressional force follows immediately the cycle of disengagement from impressional force, the incorrect pulse thus not being perceptible in the operation of the printing machine.

BRIEF DESCRIPTION OF THE DRAWINGS

One of the possible embodiments is diagrammatically represented in the accompanying drawings, of which

DESCRIPTION OF THE PREFERRED EMBODIMENT

Figure 2:
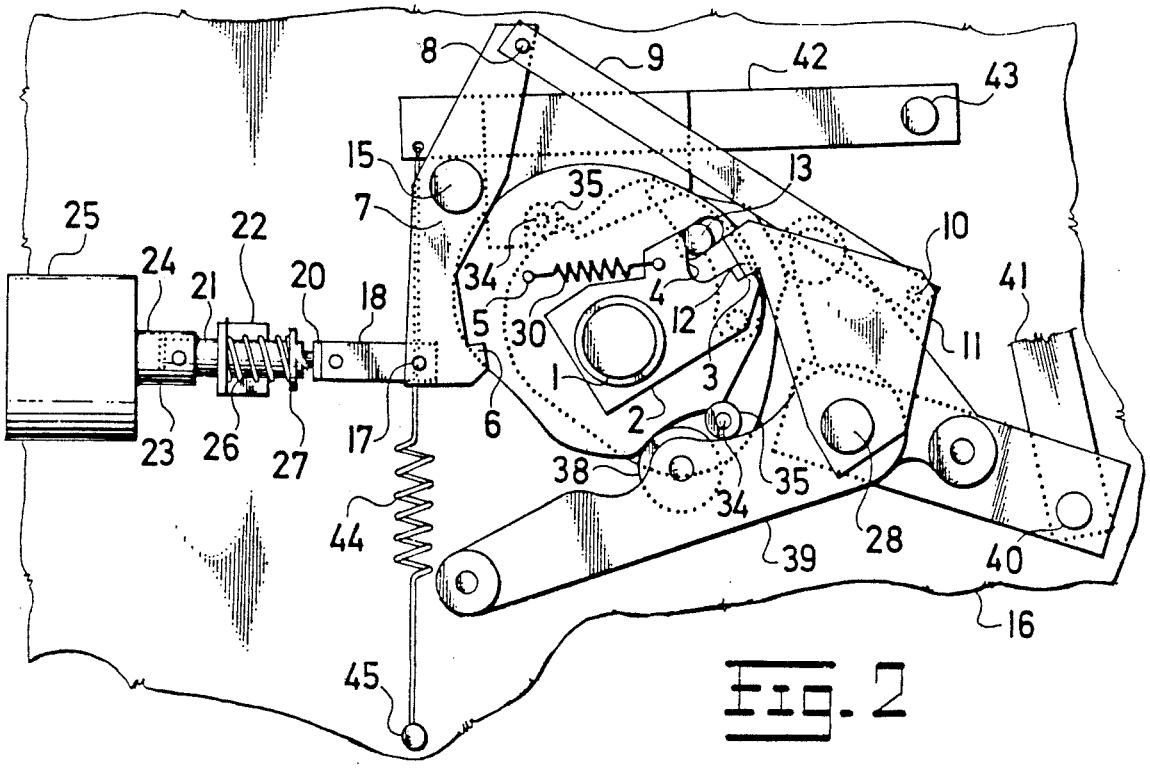
FIG. 2 is a front elevation of the device in operative position, i.e. upon engagement of impressional forces.
Figure 3:
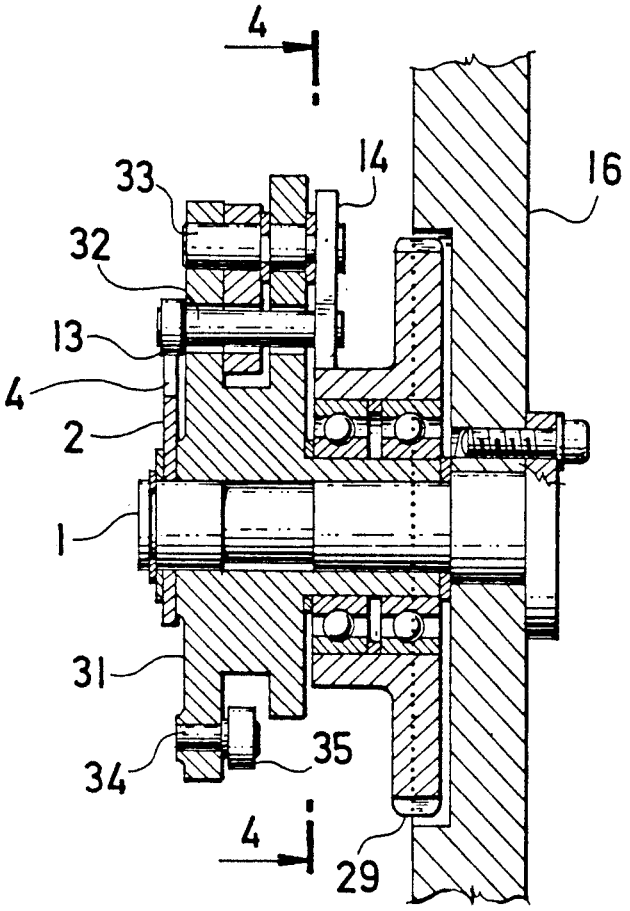
FIG. 3 is the device in partial section through plane 3—3 of FIG. 1 in angular displacement.
Figure 4:
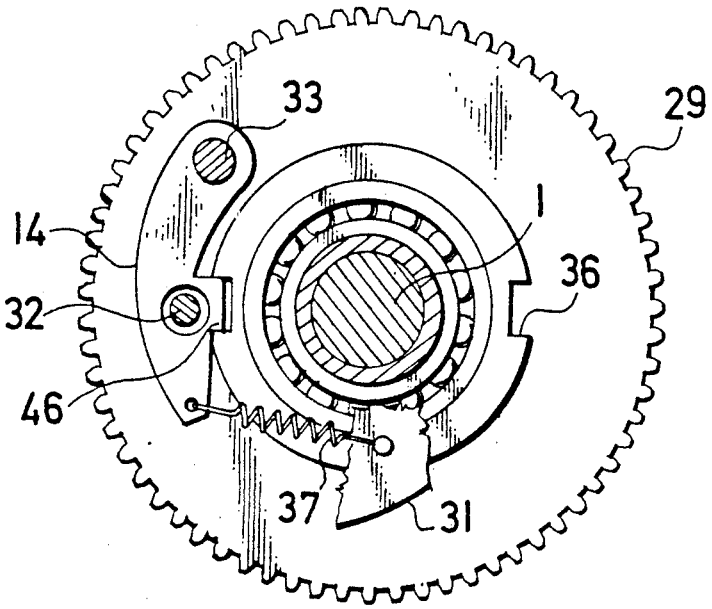
FIG. 4 is a partial section through plane 4—4 of FIG. 3 in angular displacement.

The device of the invention comprises a first supporting pin 1, mounted in the side plate 16 of a printing machine. On the first supporting pin 1 are rotatably mounted a driving gear 29 and a double cam 31. Further is mounted on the first supporting pin 1 is a gate 2, provided with a stop 3, a run-out path 4 and a hole 5. The stop 3 of gate 2 is in engagement, upon disengagement of impressional forces, with the first projection 6 on a first catch 7, which is swingably mounted on a second supporting pin 15, which is fixed in the side plate 16 of the printing machine. An operating tie rod 18 is swingably fastened on the first catch 7, by means of a third pin 17. On the side plate 16 of the printing machine, guide 22 is fastened, in which is displaceably mounted a clutch 21, on which is fastened an adjustable link 20. The operating tie rod 18 is connected, by means of draw pin 19, to clutch 21 which is, by means of a fourth pin 23 connected to the core 24 of electromagnet 25. One end of a pressure spring 26, mounted on clutch 21, bears against guide 22. The pressure spring 26 bears with its other end against supporting ring 27, which is mounted stationarily on clutch 21. On the first catch 7 is swingably fastened, by means of first pin 8, connecting tie rod 9 which is swingably fastened with its other end, by means of second pin 10, to a second catch 11. The second catch 11 is mounted slightly turnably on basic pin 28, mounted in side plate 16. The second catch 11 has a second projection 12 which, upon engagement of impressional forces, becomes engaged with stop 3 of gate 2 (FIG. 2). An operating roller 13 mounted rotatably on driving pin 32 bears against the run-out path 4 of gate 2, said driving pin 32 being fixed in a driver 14. Driver 14 is mounted swingably, by means of a third supporting pin 33 on double cam 31. Two fourth supporting pins 34 are stationarily mounted on double cam 31, and on them are mounted two positioning rollers 35. Driving gear 29 is provided in its hub with two driving notches 36, which are in engagement with claw 46 of driver 14. Tension spring 37, which has one end fastened on double cam 31, is suspended with its other end on driver 14. A rolling lifting roller 38 engages the other cam surface of double cam 31. Roller 38 is mounted for rotation on a multiple arm lever 39, which is swingably mounted on basic pin 28. One end of an operative tie rod 41 is swingably mounted on multiple arm lever 39. Tie rod 41 is connected at its other end to a mechanism for dislocating the impression cylinders (not represented). The positioning roller 35 is in engagement with a positioning pawl 42, provided with a slot, mounted swingably on a guy pin 43, fastened in the side plate 16 of the printing machine. At the end of positioning pawl 42 is suspended one end of a tension spring 44, of which the other end is suspended on hinged pin 45, which is fixed in the side plate 16 of the printing machine.

Figure 1:
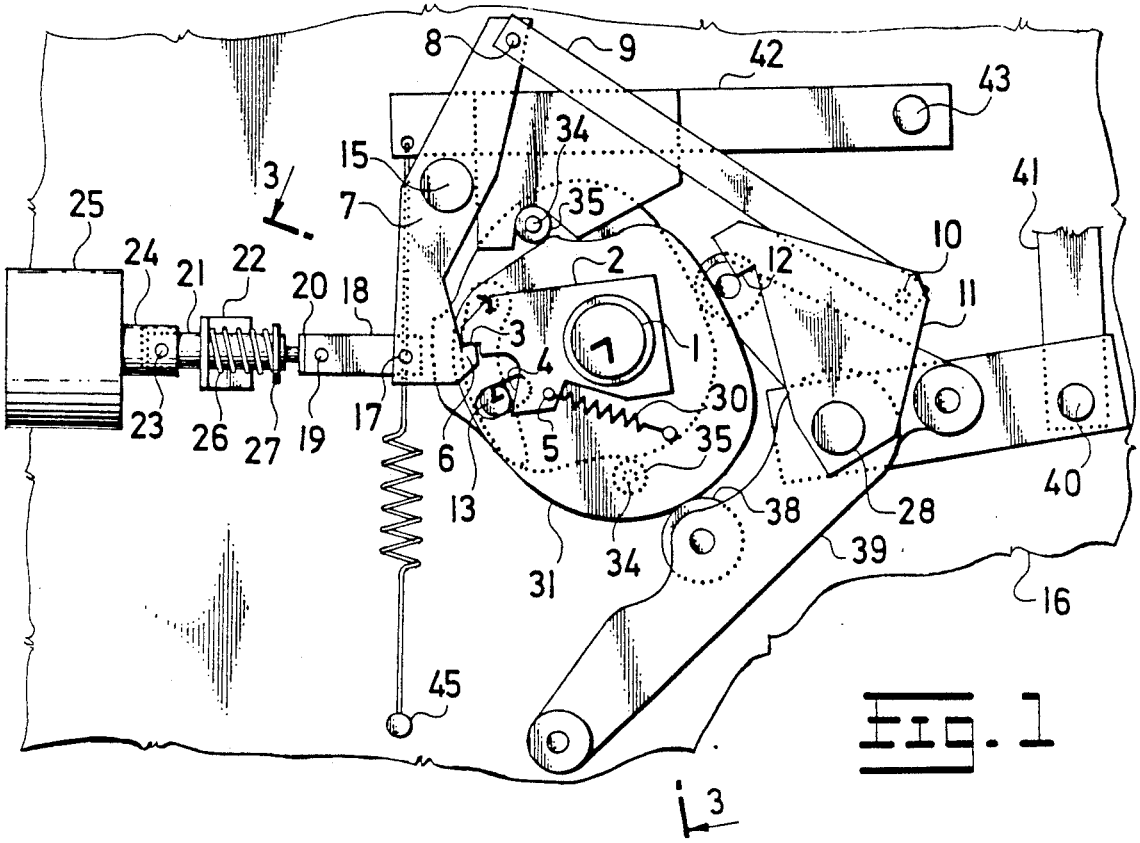
FIG. 1 represents a front elevation of the device in inoperative position, i.e. upon disengagement of impressional forces.

The device specified above operates as follows: The device for controlling impressional forces according to the present invention has two positions. The first position is the inoperative position, i.e. upon disengagement of the printing machine of impressional forces, in which the device is positioned according to FIG. 1. The second position is the operative position, i.e. upon engagement of the machine into impressional force, when the device is positioned according to FIG. 2. To move the device from the inoperative position to the operative position, a short pulse is generated by an electronic controller (not shown), or the machine attendant, by which the core 24 with clutch 21 is displaced, whereupon the pressure spring 26 is compressed. Thereby, also the operating tie rod 18 is displaced, whereupon catches 7,11 are withdrawn for a short interval with the first projection 6 and the second projection 12 in a direction away from the first supporting pin 1. Thereby, stop 3 slips down from the first projection 6 of first catch 7, and gate 2 is slightly turned by tension spring 30 in such manner, that operating roller 13 moves along run-out path 4 in the direction toward the center of the first supporting pin 1. Thereby, driver 14 is slightly turned by the action of tension spring 37, and its claw 46 engages one of the driving notches 36 of the rotating driving gear 29. The driving gear 29 begins to drive the double cam 31, and therewith also gate 2 in such manner, until stop 3 of gate 2 bears against the second projection 12 of second catch 11. Therebefore, the first catch 7 and the second catch 11, upon termination of the pulse of electromagnet 25 returned, by action of pressure spring 26, into their initial positions, so that both the first projection 6 and the second projection 12 are sloped in the direction toward the first supporting pin 1. By contacting the second projection 12 by stop 3, the slight turning motion of gate 2 is stopped, whereupon the operating roller 13 moves out along the run-out path 4 of gate 2, the claw 46 of driver 14 being thus disengaged from the driving notch 36 of driving gear 29. Consequently, the rotary motion of double cam 31 is stopped in the second position, in which the double cam 31 is secured by the positioning pawl 42 which bears with its recess against one of the positioning rollers 35. By slightly turning double cam 31 from the inoperative position to the operative position, multiple arm lever 39 is slightly turned by means of the engaging lifting roller 38, whereby an operative tie rod 41, which sets the impression cylinders into impressional force, is displaced. The displacement from the operative position into the inoperative position is performed in such manner, that core 24 displaces clutch 21 by intermediary of electromagnet 25, the compression spring 26 is compressed, and thereby also the operating tie rod 18 is displaced. Thereby, the first catch 7 and the second catch 11 are withdrawn for a short interval by first projection 6 and second projection 12 in the direction away from the first supporting pin 1. Stop 3 is disengaged from the second projection 12, and gate 2 is slightly turned by tension spring 30 in such manner, that the operating roller 13 slides along the run-out path 4 of gate 2 in the direction toward the center of the first supporting pin 1. By action of tension spring 37, driver 14 gets with its claw 46 into engagement with the driving notch 36 in the hub of the rotating driving gear 29. The driving gear 29 begins to drive the double cam 31 and, together therewith, also gate 2 in such manner, until its stop 3 contacts the first projection 6 of first catch 7, which is situated, together with the second catch 11, in the initial position. Thus, the first projection 6 and the second projection 12 are inclined in the direction toward the first supporting pin 1. Catches 7, 11 are returned to their initial positions upon termination of the pulse of electromagnet 25 by action of pressure spring 26. By contact of stop 3 of gate 2 with the first projection 6, the rotary motion of gate 2 is stopped, whereby operating roller 13 moves along the run-out path 4, and thereupon the claw 46 of driver 14 is disengaged from the driving notch 36 of driving gear 29. In consequence thereof, the rotary motion of double cam 31 is stopped in the inoperative position, in which the double cam 31 is secured by engagement of the positioning roller 35 into the recess of positioning pawl 42. By slightly turning double cam 31 from the operative into the inoperative position, multiple arm lever 39 is turned by rolling of the lifting rollers 38 about the circumference of double cam 31, whereupon the operative tie rod 41 is displaced, which moves the impression cylinders from the impressional forces.

In the case, that engagement of the mechanism from its inoperative position into the operative position takes place and the electronic controller detects an incorrect pulse, a compensation pulse is emitted by the electronic controller by means of electromagnet 25. Thus, the first projection 6 and the second projection 12 are withdrawn in the direction from the supporting pin 1. Thus, gate 2 moves freely with its stop 3 about the second projection 12, the device thus being not stopped in its operative position, and continuing its returning into the inoperative position.

We claim:

1. A device for controlling a lifting and throw-off of an impression cylinder in a printing machine having a side plate (16) with a basic pin (28) and an operative tie rod (41) mounted for movement to the basic pin for lifting and throw-off of the impression cylinder, the device comprising:

a first supporting pin (1) fixed to the side plate (16);

a driving gear (29) mounted for rotation on the first supporting pin (1);

a gate (2) mounted for rotation to the first supporting pin (1), said gate having a run-out path (4) and a stop (3);

a second supporting pin (15) fixed to the side plate (16);

a first catch (7) mounted for rotation to said second supporting pin (15), said first catch (7) having a first projection (6) engagable with said stop (3) when the device is an inoperative position corresponding to a position of the operative tie rod (41) upon throw-off of the impression cylinder;

a second catch (11) mounted for rotation to the basic pin (28), said second catch (11) having a second projection (12) which is engagable with said stop (3) upon rotation of said gate (2), in an operative position for the device, corresponding to a position of the operative tie rod (41) upon lifting of the impression cylinder;

a connecting tie rod (9) having one end pivotally connected to said first catch (7) and an opposite end pivotally connected to said second catch (11) for transmitting rotation of said first catch (7) to rotation of said second catch (11);

cam means (31,39) mounted for movement to the side plate (16) and engaged with the operative tie rod (41) for moving the operative tie rod (41) with movement of the cam means (31,39);

a driver (14) mounted for movement to the cam means (31,39) said driver (14) having an engagement position for engaging said driving gear (29) to said cam means (31,39) for transmitting rotation of said driving gear into movement of said cam means, and a disengagement position, disengaging said driving gear from said cam means; and an operating roller (13) connected to said driver (14) and engagable with said run-out path (4), said run-out path being shaped so that with rotation of said gate from the inoperative position of the device, said first projection (6) releases said stop (3) and causes movement of said operating roller (13) to move said driver (14) into said engagement position, said run-out path (4) being shaped so that when said gate rotates into the operative position of the device, said second projection (12) engages with said stop (3) and said operating roller (13) is moved to move said driver (14) into said disengagement position.

2. A device according to claim 1, including an electromagnet (25) having a movable core (24), a guide (22) mounted to the side plate (16) adjacent the electromagnet (25), a clutch (21) slidably mounted to the guide (22) and connected to the core (24) for movement of the clutch with movement of the core, a pressure spring (26) engaged between the guide (22) and the clutch (21) for a return movement of the clutch after the clutch has been moved by movement of the core, an adjustable link (20) connected to said clutch (21), an operating tie rod (18) connected to the adjustable link (20) for movement of the operating tie rod (18) with movement of the clutch (21), said operating tie rod (18) being connected to said first catch (7) for rotating said first catch (7) with movement of said clutch (21).

3. A device according to claim 2, wherein said connecting tie rod (9) is connected to said first catch (7) at a first pin (8) and said connecting tie rod (9) is connected to said second catch (11) at a second pin (10), said first pin (8) and said first projection (6) being positioned on said first catch (7) on opposite sides of said first supporting pin (15), said second pin (10) and said second projection (12) being positioned on said second catch (11) on the same side of said second catch (11) with respect to said basic pin (28), whereby, said first and second catches (7,11) are rotated in opposite directions for moving said first and second projections in synchronism outwardly from and inwardly toward said first supporting pin (1).

4. A device according to claim 3, wherein said connecting tie rod (9) is connected to said first catch (7) at a first pin (8) and said connecting tie rod (9) is connected to said second catch (11) at a second pin (10), said first pin (8) and said first projection (6) being positioned on said first catch (7) on opposite sides of said first supporting pin (15), said second pin (10) and said second projection (12) being positioned on said second catch (11) on the same side of said second catch (11) with respect to said basic pin (28), whereby, said first and second catches (7,11) are rotated in opposite directions for moving said first and second projections in synchronism outwardly from and inwardly toward said first supporting pin (1).

5. A device according to claim 4, wherein said cam means (31,39) comprises a cam (31) mounted for rotation to said first supporting pin (1) and a multiple arm lever (39) having a lifting roller (38) rolling against said cam (31), said multiple arm lever being rotatably mounted to said basic pin (28) and being engaged with the operative tie rod (41).

6. A device according to claim 5, including a tension spring (30) connected between said gate (2) and said cam (31) for allowing slight relative rotation between said gate and said cam for movement of said operating roller (13) against said run-out path (4), said driver (14) being pivotally mounted to said cam (31).

7. A device according to claim 6, wherein said driving gear (29) carries at least one driving notch (36), said driver (14) having a claw (46) engagable into said notch (36) and a second tension spring (37) connected between said driver and said cam for urging said claw into engagement with said notch, said run-out path being shaped for engagement with said operating roller (13) to rotate said driver (14) against biasing force of said second compression spring (37).

8. A device according to claim 7, including an electromagnet (25) having a movable core (24), a guide (22) mounted to the side plate (16) adjacent the electromagnet (25), a clutch (21) slidably mounted to the guide (22) and connected to the core (24) for movement of the clutch with movement of the core, a pressure spring (26) engaged between the guide (22) and the clutch (21) for a return movement of the clutch after the clutch has been moved by movement of the core, an adjustable link (20) connected to said clutch (21), an operating tie rod (18) connected to the adjustable link (20) for movement of the operating tie rod (18) with movement of the clutch (21), said operating tie rod (18) being connected to said first catch (7) for rotating said first catch (7) with movement of said clutch (21).

9. A device according to claim 8, including a supporting ring (36) fixed to said clutch (21), said pressure spring (26) being engaged between said supporting ring and said guide (22).

* * * * *